US006461116B2

(12) United States Patent
Harte et al.

(10) Patent No.: US 6,461,116 B2
(45) Date of Patent: Oct. 8, 2002

(54) CRANKCASE PRESSURIZING CONDUIT FOR A SWASH PLATE TYPE COMPRESSOR

(75) Inventors: Shane A. Harte, Farmington Hills; Vipen Khetarpal, Novi; Lavlesh Sud, Farmington Hills, all of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/731,143

(22) Filed: Dec. 6, 2000

(65) Prior Publication Data

US 2002/0067993 A1 Jun. 6, 2002

(51) Int. Cl.[7] ..... F04B 1/26; F04B 1/12; F04B 49/00

(52) U.S. Cl. ..... 417/222.1; 417/222.2; 417/269; 417/213; 417/307; 417/440

(58) Field of Search ..... 417/222.1, 222.2, 417/270, 269, 213, 307, 440; 92/159

(56) References Cited

U.S. PATENT DOCUMENTS 4,752,189 A 6/1988 Bearint et al. ..... 417/222.2
5,174,728 A 12/1992 Kimura et al. ..... 417/222.2
5,567,124 A 10/1996 Takenaka et al. ..... 417/222.2
5,616,008 A * 4/1997 Yokono et al. ..... 417/222.2
5,644,968 A * 7/1997 Kimura et al. ..... 92/12.2

FOREIGN PATENT DOCUMENTS

JP 6-1854461 * 7/1994
JP 9-273483 * 10/1997

* cited by examiner

*Primary Examiner*—Charles G. Freay
*Assistant Examiner*—Michael K. Gray
(74) *Attorney, Agent, or Firm*—Scott Confer

(57) ABSTRACT

A variable displacement swash plate type compressor which incorporates a conduit formed in the cylinder block to provide fluid communication between a crank chamber and one or more cylinders to eliminate the need for an orifice tube in fluid communication between a discharge chamber and the crank chamber and to increase the flow of refrigerant gas and lubricating oil to the crank chamber under all operating conditions and to increase the internal fluid pressure in the crank chamber.

14 Claims, 6 Drawing Sheets

CRANKCASE PRESSURIZING CONDUIT FOR A SWASH PLATE TYPE COMPRESSOR

FIELD OF THE INVENTION

The present invention relates to a variable displacement swash plate type compressor adapted for use in an air conditioning system for a vehicle, and more particularly to a compressor conduit means for pressurizing a crankcase to control the displacement of the swash plate of the compressor, and for facilitating lubrication of compressor components.

BACKGROUND OF THE INVENTION

Variable displacement swash plate type compressors typically include a cylinder block provided with a number of cylinders, a piston disposed in each of the cylinders of the cylinder block, a crankcase sealingly disposed on one end of the cylinder block, a rotatably supported drive shaft, and a swash plate. The swash plate is adapted to be rotated by the drive shaft. Rotation of the swash plate is effective to reciprocatively drive the pistons. The length of the stroke of the pistons is varied by the inclination of the swash plate. Inclination of the swash plate is varied by controlling the pressure differential between a suction chamber and a crank chamber. The pressure differential is typically controlled using a control valve and an orifice tube which facilitates fluid communication between a discharge chamber and the crank chamber to convey compressed gases from the discharge chamber to the crank chamber based on pressure in a suction chamber.

The compressor arrangement in the prior art described above has several disadvantages. First, due to the introduction of refrigerant gas through the orifice tube into the crank chamber, the pressure within the crank chamber cannot be accurately controlled. Second, when the compressor is operating at maximum capacity, the control valve closes, thereby eliminating flow through the orifice tube. Therefore, ineffective lubrication of the close tolerance moving parts within the crank chamber occurs due to the lack of consistent flow of refrigerant gas from the discharge chamber to the crank chamber. Finally, the tight tolerances required in the orifice tube are difficult to achieve in manufacturing due to the small diameter of the orifice tube.

An object of the present invention is to produce a swash plate type compressor wherein the pressure within the crankcase is increased and efficiently controlled.

Another object of the present invention is to produce a swash plate type compressor wherein oil flow to the crankcase during both minimum and maximum operating conditions is facilitated to result in improved lubrication of the compressor components.

SUMMARY OF THE INVENTION

The above, as well as other objects of the invention, may be readily achieved by a variable displacement swash plate type compressor comprising: a cylinder block having a plurality of cylinders arranged radially therein; a piston reciprocatively disposed in each of the cylinders of the cylinder block; a cylinder head attached to the cylinder block; a crankcase cooperating with the cylinder block to define a crank chamber; a drive shaft rotatably supported by the crankcase and the cylinder block; a swash plate adapted to be driven by the drive shaft, the swash plate having a central aperture for receiving the drive shaft, radially outwardly extending side walls, and a peripheral edge; and conduit means providing fluid communication between the crank chamber and at least one of the cylinders of the cylinder block.

BRIEF DESCRIPTION OF THE DRAWINGS

The above, as well as other objects, features, and advantages of the present invention will be understood from the detailed description of the preferred embodiment of the present invention with reference to the accompanying drawings, in which.

DETAILED DESCRIPTION OF THE PREFERRED EMBODIMENT

Figure 1:
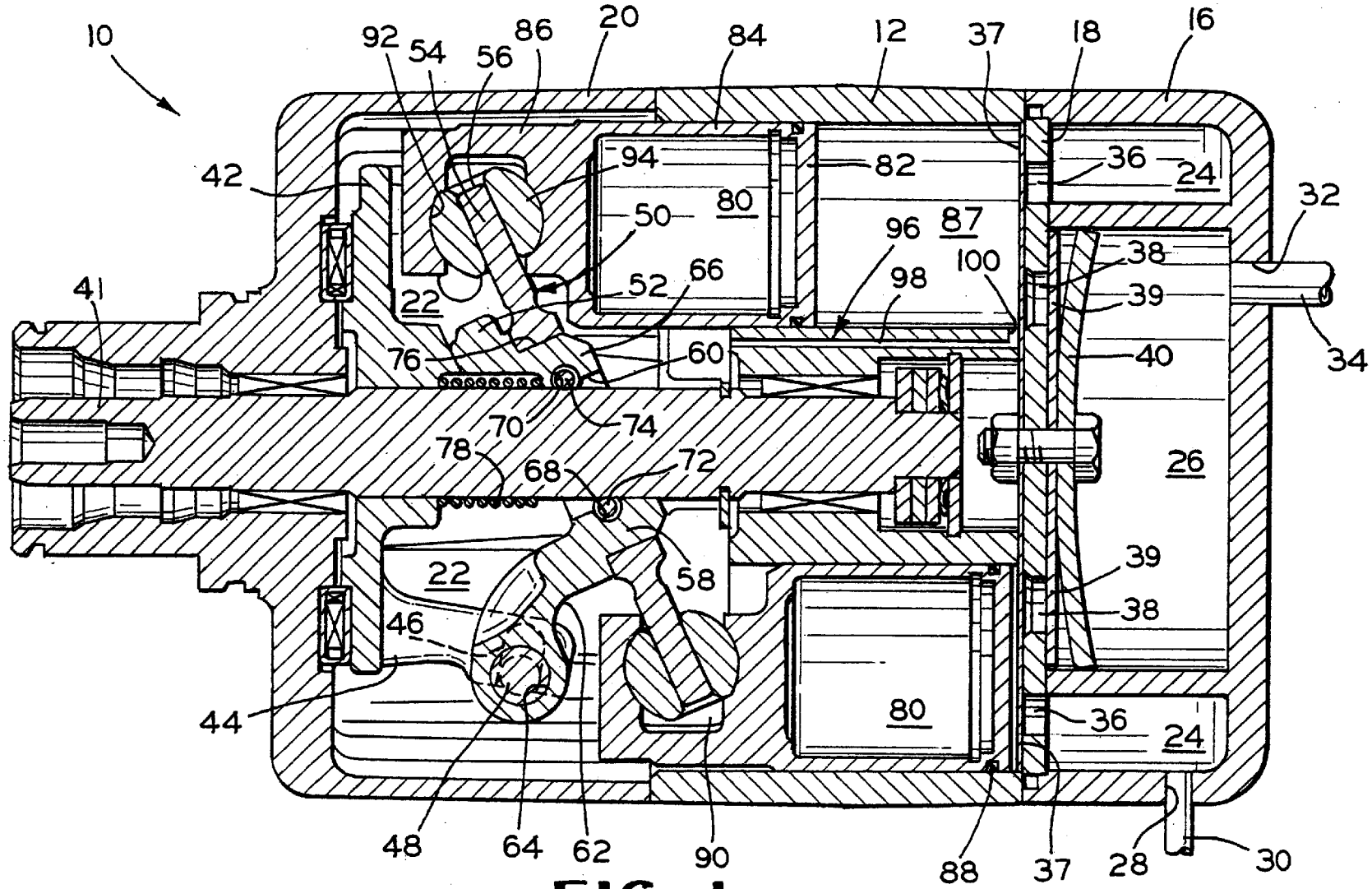
FIG. 1 is a cross sectional elevational view of a variable displacement swash plate type compressor incorporating the features of the invention, showing a conduit in fluid communication with the crank chamber and one cylinder.

Referring now to the drawings, and particularly FIG. 1, there is shown generally at 10 a variable displacement swash plate type compressor incorporating the features of the invention. The compressor 10 includes a cylinder block 12 having a plurality of cylinders 14. A cylinder head 16 is disposed adjacent one end of the cylinder block 12 and sealingly closes the end of the cylinder block 12. A valve plate 18 is disposed between the cylinder block 12 and the cylinder head 16. A crankcase 20 is sealingly disposed at the other end of the cylinder block 12. The crankcase 20 and cylinder block 12 cooperate to form an airtight crank chamber 22.

The cylinder head 16 includes a suction chamber 24 and a discharge chamber 26. An inlet port 28 and associated inlet conduit 30 provide fluid communication between the evaporator (not shown) of the cooling portion of the air conditioning system for a vehicle and the suction chamber 24. An outlet port 32 and associated outlet conduit 34 provide fluid communication between the discharge chamber 26 and the cooling portion of the air conditioning system for a vehicle. Suction ports 36 provide fluid communication between the suction chamber 24 and each cylinder 14. Each suction port 36 is opened and closed by a suction valve 37. Discharge ports 38 provide fluid communication between each cylinder 14 and the discharge chamber 26. Each discharge port 38 is opened and closed by a discharge valve 39. A retainer 40 restricts the opening of the discharge valve 39.

A drive shaft 41 is centrally disposed in and arranged to extend through the crankcase 20 to the cylinder block 12. The drive shaft 41 is rotatably supported in the crankcase 20.

A rotor 42 is fixedly mounted on an outer surface of the drive shaft 41 adjacent one end of the crankcase 20 within the crank chamber 22. An arm 44 extends outwardly from a surface of the rotor 42 opposite the surface of the rotor 42 that is adjacent the end of the crankcase 20. A slot 46 is formed in the distal end of the arm 44. A pin 48 has one end slidingly disposed in the slot 46 of the arm 44 of the rotor 42.

A swash plate 50 is formed to include a hub 52 and an annular plate 54 with a peripheral marginal edge 56. The hub 52 includes an annular main body 58 with a centrally disposed aperture 60 formed therein and an arm 62 that extends outwardly and perpendicularly from the surface of the hub 52. An aperture 64 is formed in the distal end of the arm 62 of the hub 52. One end of the pin 48 is slidingly disposed in the slot 46 of the arm 44 of the rotor 42, while the other end is fixedly disposed in the aperture 64 of the arm 62.

A hollow annular extension 66 extends from the opposite surface of the hub 52 as the arm 62. Two holes 68, 70 are formed in the annular extension 66 of the hub 52. Two pins 72, 74 are disposed in the holes 68, 70, respectively. A portion of the outer surface of the pins 72, 74 extend inwardly within the hollow annular extension 66 of the hub 52.

The annular plate 54 has a centrally disposed aperture 76 formed therein to receive the annular extension 66 of the hub 52. The annular extension 66 is press fit in the aperture 76 of the annular plate 54. The drive shaft 41 is adapted to extend through the hollow annular extension 66.

A helical spring 78 is disposed to extend around the outer surface of the drive shaft 41. One end of the spring 78 abuts the rotor 42, while the opposite end abuts the hub 52 of the swash plate 50.

A piston 80 is slidably disposed in each of the cylinders 14 in the cylinder block 12. Each piston 80 includes a head 82, a middle portion 84, and a bridge portion 86. A compression chamber 87 is formed between the head 82 of piston 80 and the valve plate 18. A circumferential groove 88 is formed in an outer cylindrical wall of the head 82 to receive piston rings (not shown). The middle portion 84 terminates in the bridge portion 86 defining an interior space 90 for receiving the peripheral marginal edge 56 of the annular plate 54. Spaced apart concave pockets 92 are formed in the interior space 90 of the bridge portion 86 for rotatably containing a pair of semi-spherical shoes 94. The spherical surfaces of the shoes 94 are disposed in the shoe pockets 92 with a flat bearing surface disposed opposite the spherical surface for slidable engagement with the opposing sides of the annular plate 54.

Figure 2:
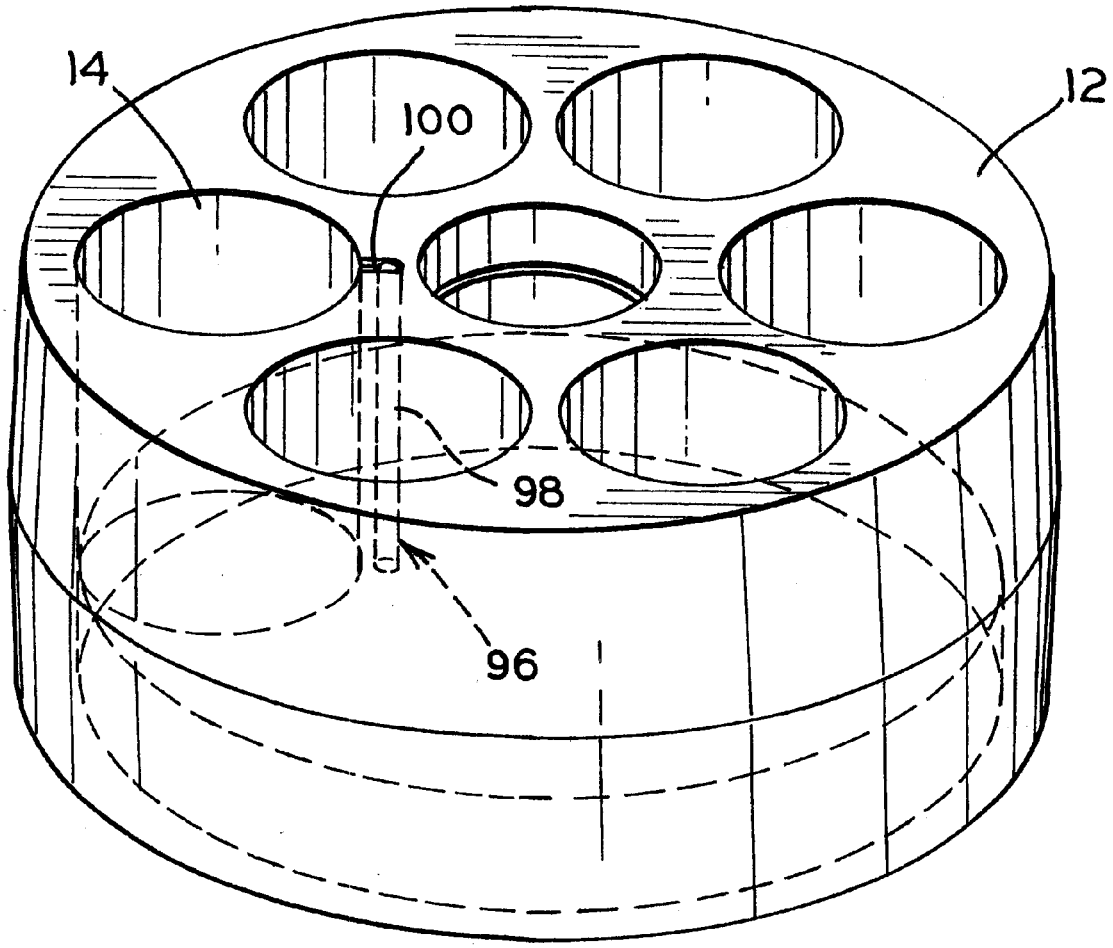
FIG. 2 is a perspective view of the cylinder block of the compressor illustrated in FIG. 1 showing the features of the invention, the bore portion of the conduit is illustrated by a phantom line.

A channel or conduit 96, illustrated in FIGS. 1 and 2, is disposed between the crank chamber 22 and one of the cylinders 14. The conduit 96 is formed by a bore portion 98 and a slot portion 100. The bore portion 98 extends longitudinally through the cylinder block 12 adjacent and substantially parallel to one of the cylinders 14. The slot portion 100 is formed in the surface of the cylinder block 12 adjacent to the valve plate 18, and extends laterally from one of the cylinders 14 to the bore portion 98. The conduit 96 provides direct fluid communication between the crank chamber 22 and the compression chamber 87 of one of the cylinders 14. In FIG. 2, only one cylinder is illustrated by a phantom line, however it is understood that the embodiment cylinder block illustrated includes six cylinders.

Figure 6:
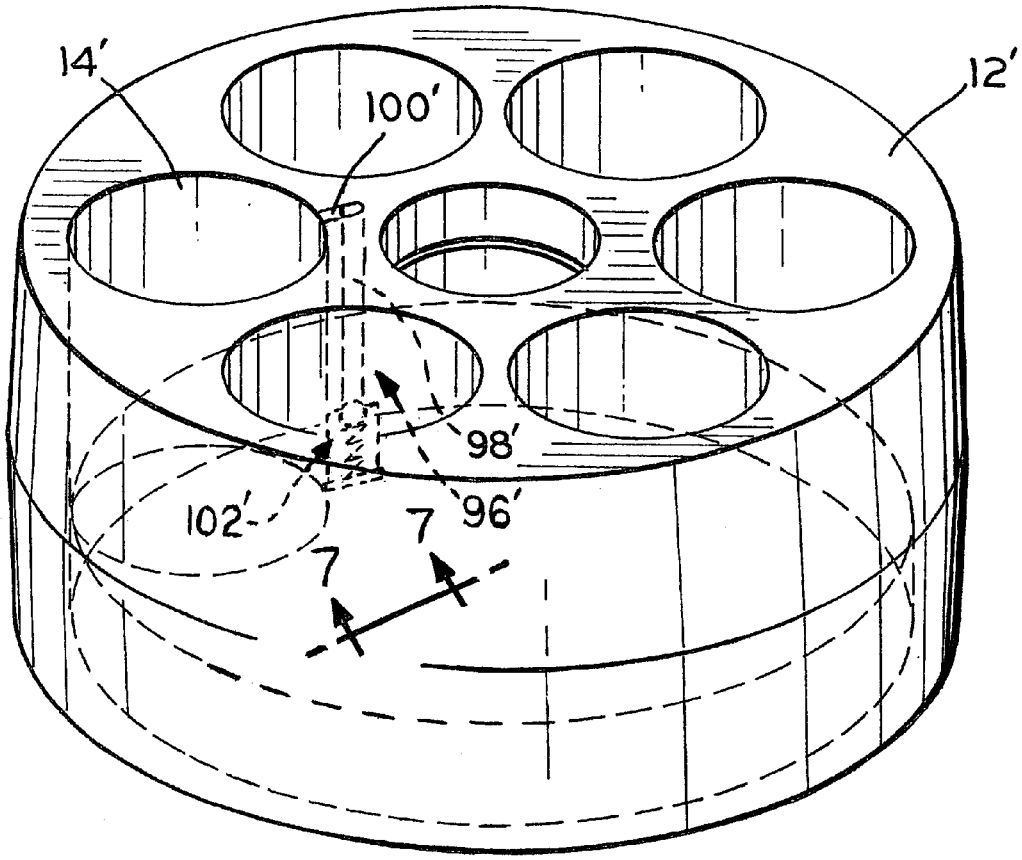
FIG. 6 is a perspective view of an alternate embodiment of the invention of FIG. 1 schematically showing a ball type valve in the conduit of the cylinder block.
Figure 7:
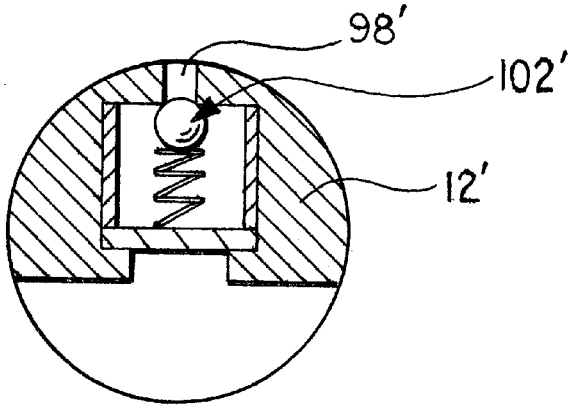
FIG. 7 is a partial cross sectional elevational view of the embodiment illustrated in FIG. 6.

In an alternate embodiment, a control valve 102' may be disposed in the conduit 96' for controlling the flow of refrigerant gas from the cylinder 14' to the crank chamber 22, as illustrated in FIGS. 6 and 7. It should be noted that the conduit 96' is rotated from the location of FIG. 2 in order to accommodate the control valve 102'. The control valve 102' may be of any conventional type such as, for example, a ball type valve. The control valve 102' may be adapted to receive a signal from a remote source to vary the flow of the refrigerant gas therethrough. Either a mechanical or electronic type control valve may be used. The mechanical type control valve can be arranged to receive either a temperature or pressure control signal from an evaporator in the air conditioning system of a vehicle. Alternatively, the electronic type control valve is arranged to receive an electrical signal from a microprocessor. The microprocessor for the electronic type control valve monitors the discharge pressure of the compressor, the RPM of the vehicle engine, and the like, to control the flow of refrigerant gas from the one of the cylinders 14', through the conduit 96', and to the crank chamber 22.

The operation of the compressor 10 is accomplished by rotation of the drive shaft 41 by an auxiliary drive means (not shown), which may typically be the internal combustion engine of a vehicle. Rotation of the drive shaft 41 causes the rotor 42 to correspondingly rotate with the drive shaft 41. The swash plate 50 is connected to the rotor 42 by a hinge mechanism formed by the pin 48 slidingly disposed in the slot 46 of the arm 44 of the rotor 42 and fixedly disposed in the aperture 64 of the arm 62 of the hub 52. As the rotor 42 rotates, the connection made by the pin 48 between the swash plate 50 and the rotor 42 causes the swash plate 50 to rotate. During rotation, the swash plate 50 is disposed at an inclination. The rotation of the swash plate 50 is effective to reciprocatively drive the pistons 80. The rotation of the swash plate 50 further causes a sliding engagement between the opposing sides of the annular plate 54 and the cooperating spaced apart shoes 94. The reciprocation of the pistons 80 causes refrigerant gas to be introduced from the suction chamber 22 into the respective cylinders 14 of the cylinder head 16. The reciprocating motion of the pistons 80 then compresses the refrigerant gas within each cylinder 14. When the pressure within each cylinder 14 exceeds the pressure within the discharge chamber 26, the compressed refrigerant gas is discharged into the discharge chamber 26.

The capacity of the compressor 10 can be changed by changing the inclination of the swash plate 50 and thereby changing the length of the stroke for the pistons 80. The inclination of the swash plate 50 is changed by controlling the pressure differential between the crank chamber 22 and the suction chamber 24. The pressure differential is controlled by controlling the net flow of refrigerant gas from the at least one cylinder 14 to the crank chamber 22 through the conduit 96.

Figure 3:
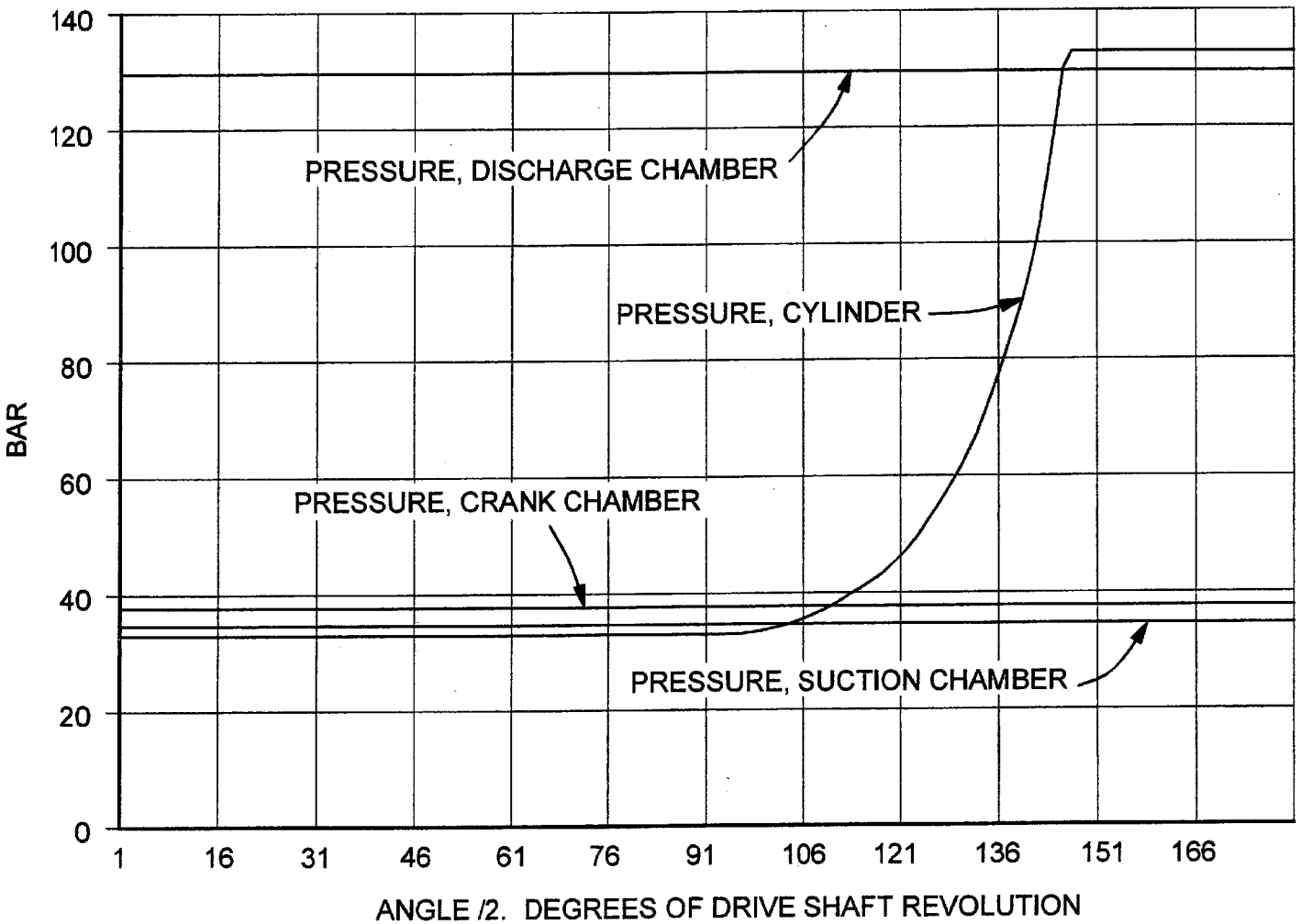
FIG. 3 is a graph illustrating the relationship between the pressure in the crank chamber, discharge chamber, suction chamber, and cylinder during one revolution of the compressor.

Specifically, as the piston 80 is caused to move toward a bottom dead center position, the pressure within the cylinder 14 is less than the pressure within the suction chamber 24. The suction valve 37 is caused to open causing refrigerant gas to flow into the cylinder 14 through the suction port 36. As illustrated in FIG. 3, the pressure within the crank chamber 22 remains at a level between the pressure within the suction chamber 24 and the pressure within the discharge chamber 26 during rotation of the drive shaft 41.

Conversely, as the piston 80 is caused to move toward a top dead center position, the refrigerant gas within the cylinder 14 is compressed until the pressure within the cylinder 14 is caused to exceed the pressure within the discharge chamber 26. The discharge valve 39 is caused to open and refrigerant gas is caused to flow through the discharge port 38 to the discharge chamber 26.

Figure 4:
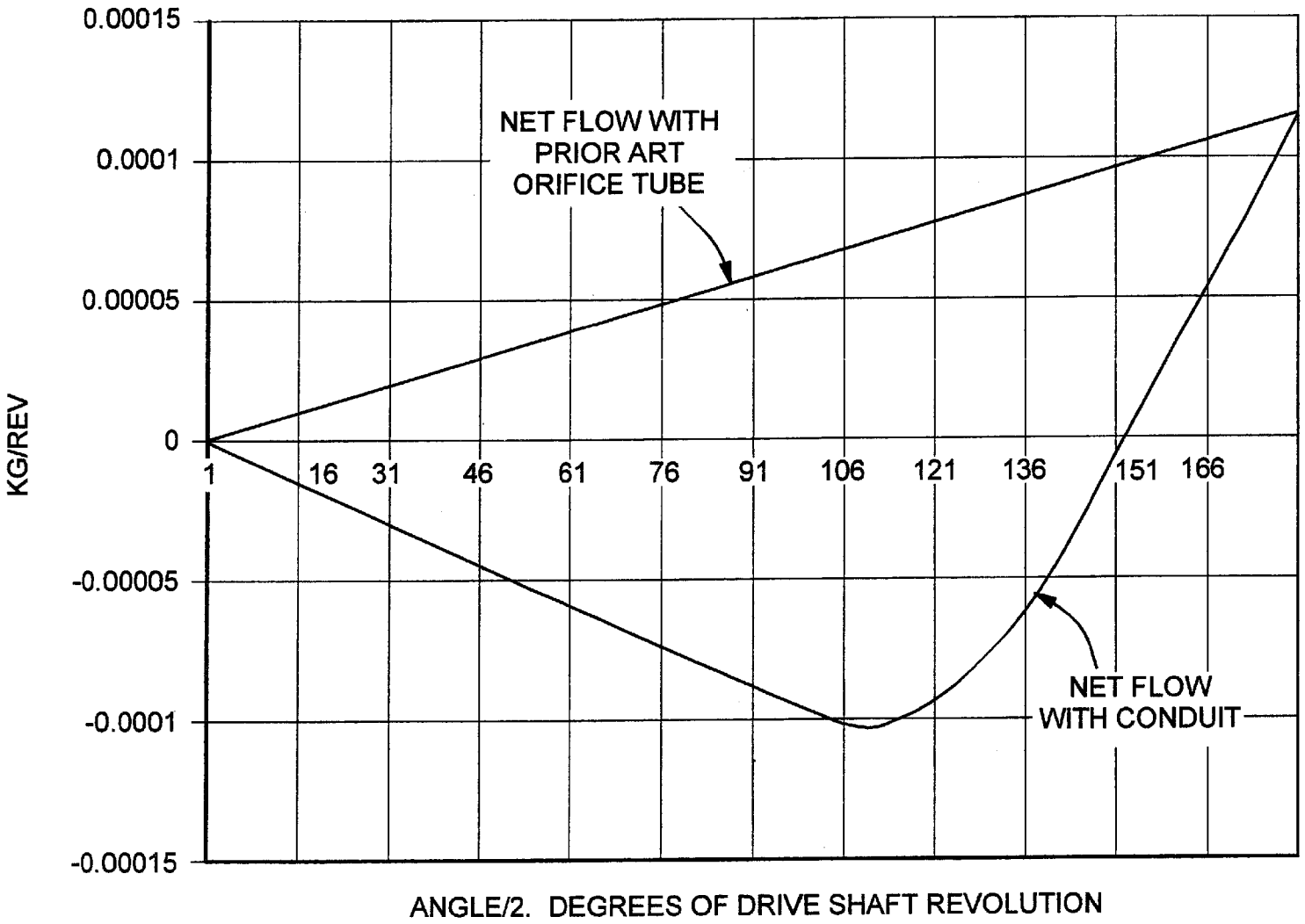
FIG. 4 is a graph illustrating the relationship between the net flow of refrigerant gas from a cylinder into the crank chamber for a prior art compressor having an orifice tube, and the net flow of refrigerant gas from a cylinder into the crank chamber for a compressor incorporating the conduit of the present invention.
Figure 5:
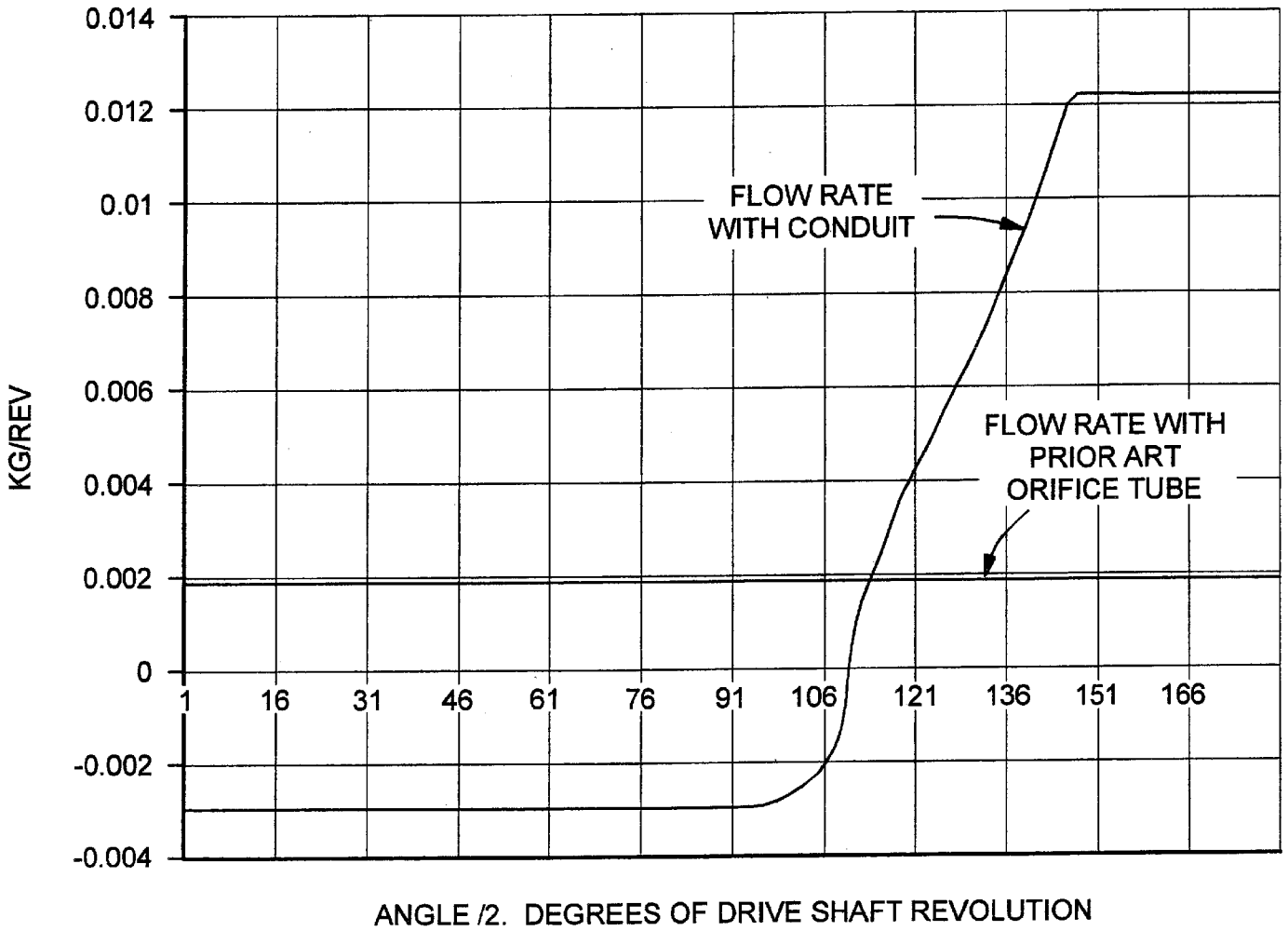
FIG. 5 is a graph illustrating the relationship between flow rate of refrigerant gas for a prior art compressor having an orifice tube, and the flow rate of refrigerant gas for a compressor incorporating the conduit of the present invention.

Further, as the piston 80 is caused to move toward a bottom dead center position within the at least one cylinder 14, the pressure within the cylinder 14 is less than the pressure within the crank chamber 22, causing refrigerant gas to flow through the conduit 96 to the cylinder 14. As the piston 80 is caused to move toward a top dead center position, the refrigerant gas within the cylinder 14 is compressed causing the pressure within the cylinder 14 to increase and exceed the pressure within the crank chamber 22. When the pressure within the cylinder 14 exceeds the pressure within the crank chamber 22, refrigerant gas is caused to flow through the conduit 96 to the crank chamber 22. Additionally, as the refrigerant gas within the cylinder 14 is compressed, the net flow and the rate of flow of refrigerant gas from the cylinder 14 to the crank chamber 22 are increased and become positive, as illustrated in FIGS. 4 and 5.

By introducing the refrigerant gas from the cylinder 14 into the crank chamber 22 through the conduit 96, instead of introducing the refrigerant gas from the discharge chamber 26 into the crank chamber 22 through an orifice tube, several benefits are apparent. The capacity and efficiency of the compressor 10 have been maximized. The orifice tube of prior art compressors bypasses compressed refrigerant gas from the discharge chamber 26 to the crank chamber 22, thereby preventing the compressed gas from being used in the cooling portion of the air conditioning system for a vehicle. By creating a conduit communicating the crank chamber 22 and the one of the cylinders 14, the flow of refrigerant gas from the cylinder 14 into the crank chamber 22 is efficiently controlled. Rather than bleeding highly pressurized refrigerant gas from the discharge chamber 26 into the crank chamber 22, the net flow of refrigerant gas is from the one of the cylinders 14 into the crank chamber 22. Because refrigerant gas flows from the cylinder 14 to the crank chamber 22 before the pressure of the refrigerant gas reaches the higher pressure within the discharge chamber 26, the net flow of refrigerant gas into the crank chamber 22 occurs at a lower pressure than with a prior art orifice tube.

An additional benefit of the present invention is that oil present in the refrigerant gas provides lubrication to the close tolerance moving components of the compressor 10. The lubrication maximizes the durability of the compressor 10.

Finally, by introducing the refrigerant gas to the crank chamber 22 through the conduit 96, the orifice tube of prior art is eliminated.

Use of the control valve 102 of the alternate embodiment controls the flow of refrigerant gas between the cylinder 14 and the crank chamber 22. Only unidirectional flow is permitted from the cylinder 14 to the crank chamber 22.

What is claimed is:

1. A variable displacement swash plate type compressor comprising:

a cylinder block having a plurality of cylinders arranged radially therein;

a piston reciprocatively disposed in each of the cylinders of said cylinder block;

a cylinder head attached to said cylinder block;

a crankcase cooperating with said cylinder block to define a crank chamber;

a drive shaft rotatably supported by said crankcase and said cylinder block;

a swash plate adapted to be driven by said drive shaft, said swash plate having a central aperture for receiving said drive shaft, radially outwardly extending sidewalls, and a peripheral edge; and a conduit providing direct fluid communication between the crank chamber and a compression chamber of at least one of the cylinders of said cylinder block.

2. The compressor according to claim 1, wherein a control valve is disposed in said conduit.

3. The compressor according to claim 2, wherein s aid control valve adjustably controls the flow of refrigerant gas from the at least one of the cylinders of said cylinder block to the crank chamber of said crankcase.

4. The compressor according to claim 3, wherein said control valve is a ball type valve.

5. The compressor according to claim 1, wherein said conduit includes a channel for fluidly communicating the crank chamber and at least one of the cylinders of said cylinder block.

6. A cylinder block for a variable displacement swash plate type compressor, the compressor having a cylinder head and a crankcase forming a crank chamber therein, the cylinder block comprising:

a plurality of cylinders arranged radially within the cylinder block; and a conduit providing direct fluid communication between the crank chamber and a compression chamber of at least one of said plurality of cylinders of the cylinder block.

7. The cylinder block according to claim 1, wherein said control valve adjustably controls the flow of refrigerant gas from the at least one of the cylinders of said cylinder block to the crank chamber of said crankcase.

8. The cylinder block according to claim 7, wherein said control valve is a ball type valve.

9. The cylinder block according to claim 6, wherein a control valve is disposed in said conduit.

10. A variable displacement swash plate type compressor comprising:

a cylinder block having a plurality of cylinders arranged radially therein;

a piston reciprocatively disposed in each of the cylinders of said cylinder block;

a cylinder head attached to said cylinder block, said cylinder head having a suction chamber and a discharge chamber formed therein;

a crankcase attached to said cylinder block and cooperating with said cylinder block to define a crank chamber;

a drive shaft rotatably supported by said crankcase and said cylinder block and adapted to be coupled to an auxiliary drive means;

a rotor fixedly mounted on said drive shaft;

a swash plate adapted to be driven by said drive shaft, said swash plate having a central aperture for receiving said drive shaft, radially outwardly extending sidewalls, and a peripheral edge;

hinge means disposed between said rotor and said swash plate to hingedly connect said rotor and said swash plate; and a conduit in said cylinder block providing direct fluid communication between the crank chamber of said crank case and a compression chamber of at least one of the cylinders of said cylinder block, said conduit including a bore portion extending through said cylinder block and a slot portion extending between the bore portion and one of the cylinders in said cylinder block.

11. The compressor according to claim 10, including a control valve disposed in said conduit.

12. The compressor according to 11, wherein said control valve adjustably controls the flow of refrigerant gas from the at least one of the cylinders of said cylinder block to the crank chamber of said crankcase.

13. The compressor according to claim 12, wherein said control valve is a ball type valve.

14. The compressor according to claim 10, wherein said conduit includes a channel for fluidly communicating the crank chamber and at least one of the cylinders of said cylinder block.

* * * * *